United States Patent [19]

Nixon

[11] 4,284,201

[45] Aug. 18, 1981

[54] CHILD PROOF CAP

[75] Inventor: Eric Nixon, Richmond Hill, Canada

[73] Assignee: Anchor Cap & Closure Corporation of Canada Ltd., Ontario, Canada

[21] Appl. No.: 167,244

[22] Filed: Jul. 10, 1980

[51] Int. Cl.[3] ..... B65D 55/02

[52] U.S. Cl. ..... 215/220

[58] Field of Search ..... 215/216, 220, 219, 222

[56] References Cited

U.S. PATENT DOCUMENTS

| | | | |
|---|---|---|---|
| 3,055,524 | 9/1962 | Glasbrenner | 215/220 |
| 3,374,912 | 3/1968 | Velt | 215/220 |
| 3,472,411 | 10/1969 | Turner | 215/220 |

*Primary Examiner*—George T. Hall

*Attorney, Agent, or Firm*—Holland, Armstrong, Wilkie & Previto

[57] ABSTRACT

A safety closure cap is disclosed for sealing medicine packages and the like where it is desirable that children cannot open the package. The closure cap has an inner shell having thread means for engaging a container and has an outer shell rotatably attached in telescoping position over the inner shell. Ratchet means on the shells locks them together when they are turned onto the container as a unit as the package is sealed but is normally inoperative when the closure cap is turned for removal so that the outer shell freely rotates on the inner shell. Shell coupling for removal is provided by a pressure interlock means which is activated by an adult user forcing the outer shell downwardly on the inner shell causing the shells to rotate for removal as a unit by a forced engagement of the ratchet means.

12 Claims, 10 Drawing Figures

Fig. 1.
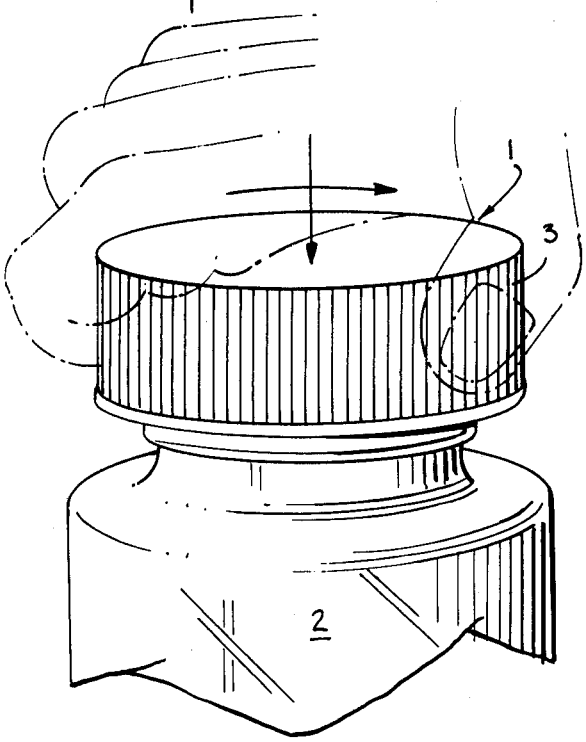
Fig. 3.
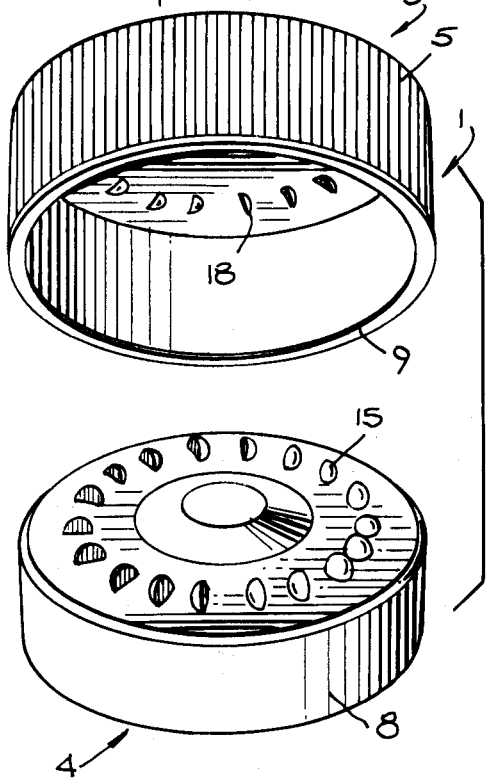
Fig. 2.
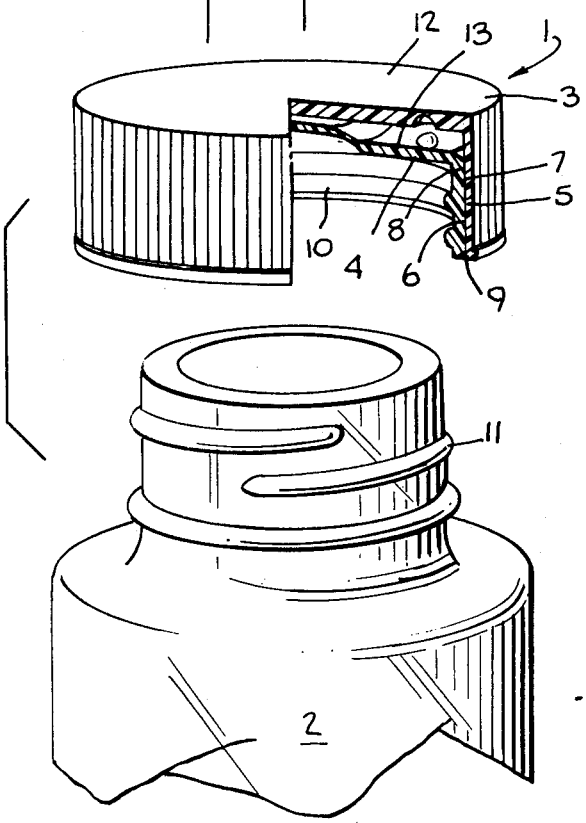
Fig. 4.
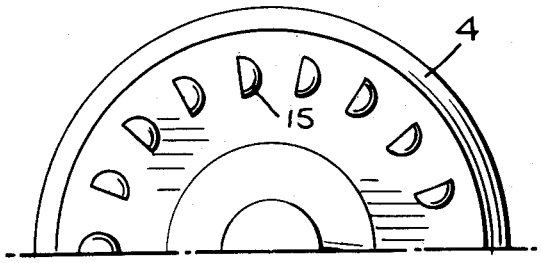
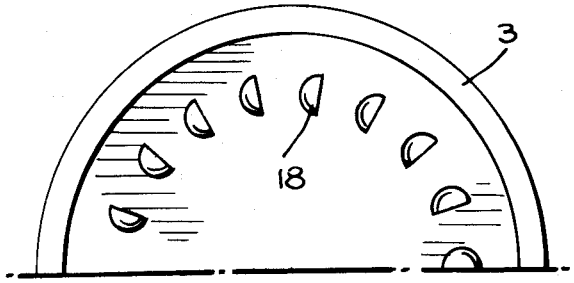
Fig. 5.

Fig. 6.
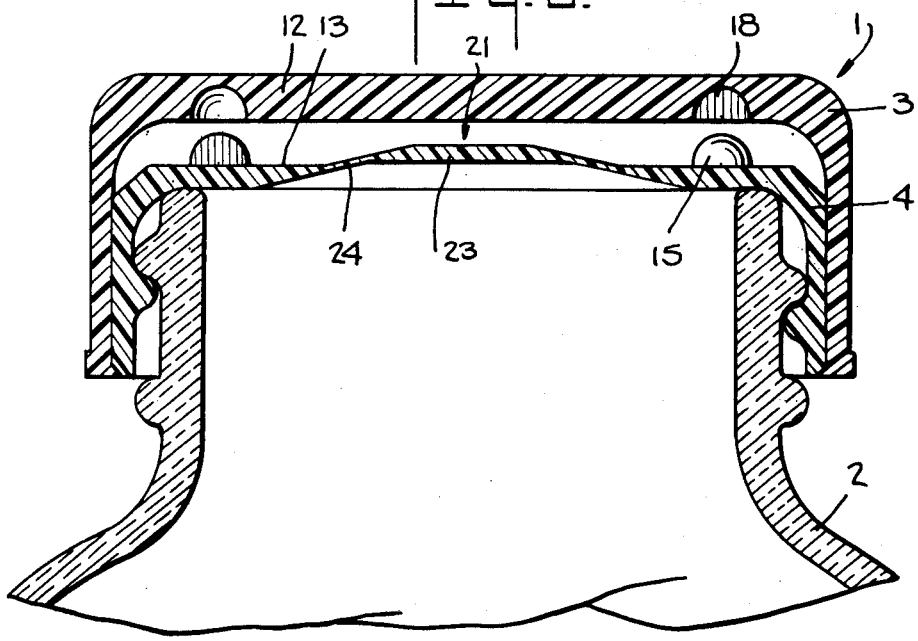
Fig. 8.
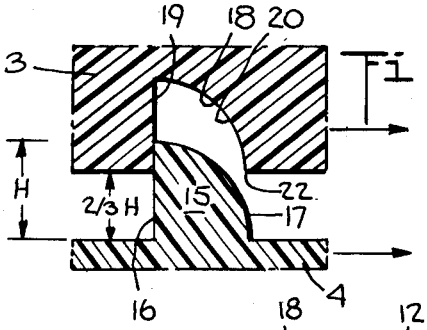
Fig. 9.
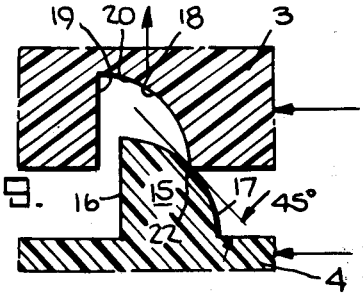
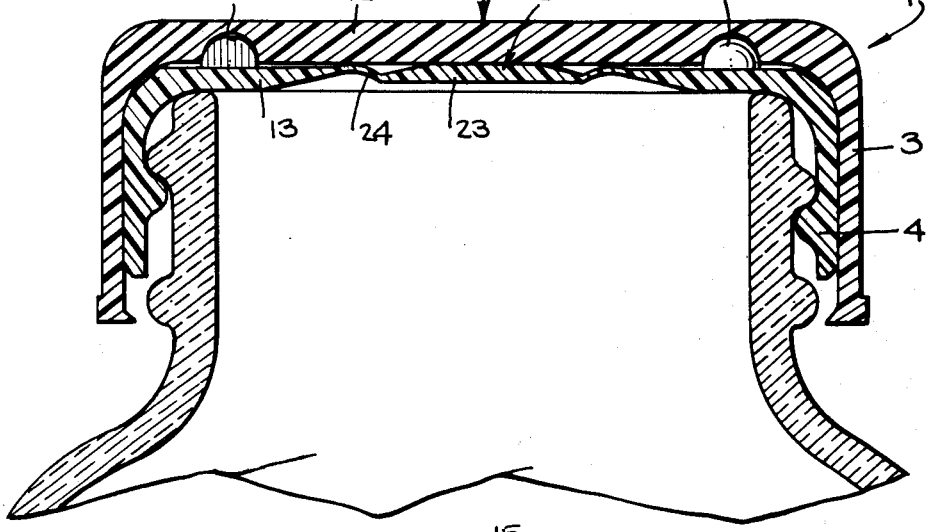
Fig. 7.
Fig. 10.
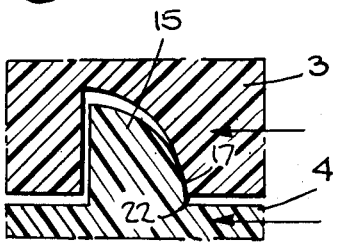

CHILD PROOF CAP

BACKGROUND OF THE INVENTION

The invention is a safety closure for a container and more particularly is a safety closure which may not be removed from a container by children and which requires manipulation by a person having adult gripping strength and reasoning powers. The closure cap is useful for sealing medicines or other packages where it is desirable to limit access to the package contents and in particular to protect young children from harm by an unauthorized or accidental use of the packaged products.

A number of safety closures have been designed for use with medicine and other potentially dangerous products. These prior closures have in certain cases been effective but in general they have been found to be difficult to remove by normal adults. In other cases, the safety closures have been too easily removed by young children or they have been unduly complicated either in the closure structure or with respect to the cooperating finish required on the container.

Prior safety closure caps, in other cases, are not readily applied to the containers during sealing operations by conventional closure cap hoppering, feeding, sealing and labeling machinery.

These objections have been overcome by the present closure cap which has an inner and an outer shell which are rotatably interconnected and which has a relatively simple coupling means for locking the shells together when they are turned onto a container and which is activated by an appropriately applied pressure grip of the user for closure cap removal.

Accordingly, an object of the present invention is to provide an improved safety closure.

Another object of the present invention is to provide a safety closure which is characterized by being easily applied during the initial sealing, which resists removal by children, and which is readily removed by responsible adults.

Another object of the invention is to provide a safety closure which is relatively easily manufactured and which may be handled by conventional container sealing machinery.

Another object of the invention is to provide an improved safety package comprising an improved safety closure for use with a container having a conventional closure engaging means.

Other and further objects of the invention will be obvious upon an understanding of the illustrative embodiments about to be described or will be indicated in the appended claims, and various advantages not referred to herein will occur to one skilled in the art upon employment of the invention in practice.

A preferred embodiment of the invention has been chosen for purposes of illustration and description and is shown in the acompanying drawings, forming a part of the specification, wherein:

FIG. 1 is a perspective view of a sealed package in accordance with the invention.

FIG. 2 is a perspective view, partially in section, of the outer closure cap of the invention removed from a container.

FIG. 3 is an exploded perspective view of the closure cap.

FIG. 4 is a top plan view of the inner shell of FIG. 3.

FIG. 5 is a bottom plan view of the outer shell of FIG. 3.

FIG. 6 is a vertical sectional view illustrating the shells in their disengaged position.

FIG. 7 is a vertical section corresponding to FIG. 6 with the shells pressed into their engaged and removal position.

FIG. 8 is an enlarged fragmentary sectional view of the ratchet means lightly engaged for cap application.

FIG. 9 is an enlarged fragmentary sectional view corresponding to FIG. 8 with the outer shell being turned off without axial pressure.

FIG. 10 is an enlarged fragmentary sectional view of the ratchet means in its engaged cap removal position.

BRIEF DESCRIPTION OF THE DRAWINGS

FIGS. 1, 2 and 3 illustrate a closure cap 1 in accordance with the invention for sealing a container 2 and having a nesting or telescoped outer shell 3 and inner shell 4. The skirt 5 of the outer shell 3 has its inner surface 6 closely and slidably positioned with respect to the outer surface 7 of the skirt 8 of the inner shell 4. An inwardly directed bead 9 on the outer shell skirt 5 retains the inner shell 4 within the outer shell 3 while permitting relative rotation between the two shells 3 and 4, as well as axial rotation of the outer shell 3 on the inner shell 4. Suitable container engaging means are provided on the skirt 8 of the inner shell 4 which are illustrated in FIG. 1 as screw threads 10 for engaging cooperating screw threads 11 on the container 2.

The safety means for the closure cap 1 includes a ratchet-like structure provided on the under side of the outer shell 3 cover 12 and the upper surface of the inner shell cover 13. The function of this safety means is to provide a positive interlock between the two shells 3 and 4 when the closure cap 1 is turned onto the container 2 while permitting a free rotation of the outer shell 3 when the closure cap 1 is turned in a removal direction by a child or another without knowledge of the removal technique. The safety means has a preferred form which permits this free relative rotation for preventing cap removal in the absence of a firm downward pressure being applied to the outer shell 3 at the same time that it is turned off. This force is set at such an amount that a child cannot apply it whether or not the child might intentionally or inadvertently attempt to apply such a downward pressure.

The safety means will now be described in more detail with particular reference being made to FIGS. 4 through 10.

A series of vertical projections or dimples 15 are formed on cover 13 of the inner shell 4. Each of the dimples 15 is characterized by having a flat surface 16 on one side and a rounded surface 17 on the opposite side preferably being in the form of about one quarter of a spherical surface. Each of the dimples 15 on the inner shell 4 is positioned beneath a complimentary recess 18 formed on the under surface of the outer shell cover 12. The recesses 18 having similar flat surfaces 19 and complimentary semi-spherical surfaces 20.

Relative rotational as well as axial movement is permitted by the telescoping positions of the inner and outer shells 3 and 4. As best illustrated in FIGS. 6 and 8, the outer shell 3 need be pressed downwardly during cap application only relatively lightly. The lower surface of the outer shell cover 12 engages a raised center panel 21 on the cover 13 of the inner shell 4. When the shells 3 and 4 are thus positioned, significant torque transfer is generated between the engaged flat portions 16 and 19 of the dimples 15 and the recesses 18. A further downward pressure on the outer shell tends to depress the panel 21 giving additional engagement between the flat portions 16 and 19 to further insure the creation of container sealing torque, however, such a pressure is not normally needed and clearly is not required during hand resealing.

As seen in FIGS. 6 and 8, the flats 19 of the recesses 18 engage the flats 16 of the dimples 15 about two thirds of the distance up each dimple 15 when the outer shell 3 has been pressed downwardly to the point where it rests against the top of the panel 21 on the inner shell 4. In this position, the flat surfaces 16 and 19 of the recesses 18 and the dimples 15 are engaged for only about one sixth or less of their areas. Nevertheless, this engagement of flat 16 with the flat 19 permits the transfer of significant torque between the outer shell 3 and the inner shell 4 with all of the recesses 18 and the dimples 15 being similarly engaged.

On the other hand, even though the outer shell is pressed downwardly as far as the raised central panel 21 when the outer shell is turned off, no significant torque is generated between the engaging curved surfaces 17 and 20 (FIG. 9). The lower corner 22 of the recess surface 20 engages the curved dimple surface 17 where it has about a 45° angle with the horizontal in a plastic to plastic engagement. The minor resulting torque is well below the amount necessary to cause the inner shell 4 to turn with the outer shell 3 so that the outer shell 3 merely spins on the inner shell 4 which remains tightly fastened to the container 2.

Instructions on the package or closure advise an adult person that downward pressure must be applied to the outer shell 3 in removing the closure cap 1 from the container 2. This pressure must be sufficient to depress the flexible raised center panel 21 of the inner shell 4 fully to the removal position illustrated in FIGS. 7 and 10. Since this requires the deformation of the plastic cover 13 it requires a significant downward pressure only possible by a mature person. With the outer and inner shells 3 and 4 pressed together in this removal position, the detents 15 enter almost completely with the corresponding recesses 18 thereby providing a substantial engagement either between the cooperating rounded surfaces 17 and 20 or at least a positioning of the recess corners 22 against generally vertical portions of the dimple surfaces 17. This engagement is sufficient to overcome the cap sealing torque and to remove the closure cap 1 from the container 2. In this position the dimples enter about ninety percent of the recess height. While the preferred embodiment of the closure cap 1 illustrates 18 detents and cooperating recesses, this number may differ. Additionally, while the preferred shaping of the detents and the recesses includes flat surfaces and semispherical surfaces for simplicity of manufacture combined with a satisfactory ratchet-like action, minor variations in the shapes of these surfaces may be employed.

The raised central panel 21 on the inner shell 4 is seen to include a thickened center portion 23 with an inclined connecting hinge or flexing portion 24. The thickness of the inclined flexing portion 24 is set for the particular diameter and the particular cap plastic being used to require a substantial downward force before the raised portion is depressed sufficiently to provide the detent engagement necessary for cap removal. This thickness has been found to be satisfactory when about 25 percent or less of the cover 13 thickness and the flexing panel forms a slight angle with the cover of about 10 to 15 degrees.

It will be seen that an improved and effective and yet relatively simple child-proof safety closure has been described. The closure has an effective safety interlock which is provided in a relatively simple construction comprising only two principal portions which are the inner and outer shells. The shell ratchet or coupling means itself has an effective yet simple design which lends itself readily to being formed by simple molding operations incident to the molding operations of the inner and outer shells. The result is an inexpensive and effective child proof safety closure.

Other and further advantages of the present invention will become apparent upon an understanding of the illustrative embodiments about to be described or will be indicated in the appended claims, and various advantages not referred to herein wil occur to one skilled in the art upon employment of the invention in practice.

Having thus described my invention, I claim:

1. A safety closure cap for sealing a container comprising the combination of an outer shell having a top and a depending skirt, an inner shell having a top and a depending skirt, means for rotatively coupling said shells together in nesting relationship, screw-type container engaging means on said inner shell for engaging cap engaging means on the container, ratchet means on said shells for coupling said shells when said outer shell is turned in a cap applying direction and permitting relative rotation between said shells when said outer shell is turned in a cap unscrewing direction and a flexible panel extending upwardly from said cover of said inner shell a portion only of the ratchet means height for resisting ratchet engagement when the outer shell is turned in an unscrewing direction and is moved towards said inner shell.

2. The safety closure cap as claimed in claim 1 in which said shell coupling means comprises bead means extending from one of said shell skirts and engaging the other of said shell shirts.

3. The safety closure cap as claimed in claim 2 in which said bead extends radially inwardly from the lower edge of the skirt of the outer shell and beneath at least a portion of the lower edge of the skirt of said inner shell.

4. The safety closure cap as claimed in claim 1 in which said ratchet means comprises dimples on the top of said inner shell and complementary recesses on the top of said outer shell.

5. A safety closure cap for sealing a container comprising the combination of an outer shell having a top and a depending skirt, an inner shell having a top and a depending skirt, means for rotatively coupling said shells together in nesting relationship, screw-type container engaging means on said inner shell for engaging cap engaging means on the container, ratchet means on said shells for coupling said shells when said outer shell is turned in a cap applying direction and permitting relative rotation between said shells when said outer shell is turned in a cap unscrewing direction, and said ratchet means comprising a plurality of dimples extending upwardly from the top of said inner shell and being formed integrally therewith, a flexible panel extending upwardly from said top of said inner shell a portion only of the detent height, and apertures on the underside of the outer shell cover positioned to at least partially engage the said detents when said outer shell is moved towards said flexible panel.

6. The safety closure cap as claimed in claim 5 in which said coupling means comprises bead means extending from one of said shell skirts and engaging the other of said shell skirts.

7. The safety closure cap as claimed in claim 6 in which said bead extends radially inwardly from the lower edge of the skirt of the outer shell and beneath at least a portion of the lower edge of the skirt of said inner shell.

8. The safety closure as claimed in claim 5 in which said dimples and recesses have a pair of intersecting surfaces one of which is planar and the other of which is a portion of a sphere.

9. The safety closure as claimed in claim 8 in which said portion of a spherical surface is a quarter of a sphere.

10. The safety closure as claimed in claim 5 in which said panel extends upwardly from the top of said inner shell about two thirds of the height of said dimples.

11. The safety closure as claimed in claim 5 in which said flexible panel comprises a disc shaped center portion and a relatively thinner annular flared flexing portion.

12. The safety closure as claimed in claim 5 in which said flexible panel comprises the central portion of the top of the inner shell with an annular flexing portion coupling said flexible panel to the outer portion of the inner shell top, and said flexing portion being relatively thinner than said panel and said outer portion of the inner shell top.

* * * * *